US006223759B1

(12) United States Patent
Flippin, Jr.

(10) Patent No.: US 6,223,759 B1
(45) Date of Patent: May 1, 2001

(54) UMBRELLA APPARATUS

(76) Inventor: J. Franklin Flippin, Jr., 2205 Widgeon Ct., Winston Salem, NC (US) 27106

( * ) Notice: Subject to any disclaimer, the term of this patent is extended or adjusted under 35 U.S.C. 154(b) by 0 days.

(21) Appl. No.: 09/480,581

(22) Filed: Jan. 10, 2000

(51) Int. Cl.[7] ..... A45B 3/00; A45B 5/00; A45B 21/00; A45B 25/24

(52) U.S. Cl. ..... 135/34.2; 135/16; 135/17; 135/66; 224/915; 52/165

(58) Field of Search ..... 135/34.2, 16, 17, 135/18, 66; 294/19.1, 915; 52/165

(56) References Cited

U.S. PATENT DOCUMENTS 255,299 * 3/1882 Keam .
629,460 * 7/1899 Nagell .
2,266,684 * 12/1941 Brown .
2,722,448 * 11/1955 Popp et al. .
3,878,573 * 4/1975 Boudewyn .
4,558,807 * 12/1985 Jackson .
5,385,161 * 1/1995 Loker et al. .
5,388,603 * 2/1995 Bauer et al. .
5,878,762 * 3/1999 Huang .

* cited by examiner

*Primary Examiner*—Robert Canfield

(57) ABSTRACT

Umbrella apparatus is provided for use by disc golfers and others. The device includes a hollow, cylindrical, longitudinal member which can provide a storage compartment for an umbrella slidably disposed therein. A suction cup mounted atop the longitudinal member allows the user to easily pick up discs without having to stoop or bend.

12 Claims, 3 Drawing Sheets

UMBRELLA APPARATUS

FIELD OF THE INVENTION

The invention herein pertains to umbrella apparatus and particularly pertains to apparatus for use by disc golfers and players.

BACKGROUND AND OBJECTIVES OF THE INVENTION

In recent years disc golf has become increasingly popular among players of all ages. Courses for players are increasing in numbers having both private and municipal sponsors. A typical round of disc golf may take several hours oftentimes subjecting the players to varying weather conditions. Players usually carry a bag containing five to ten (5–10) throwing discs which are designed for different distances. Such bags can be conveniently carried from "hole to hole" but are usually placed on the ground during tossing. Oftentimes the carrying bags become wet or dirty since they often must be placed on wet or muddy grounds. Also, many older players do not have the flexibility to continually stoop and pick up discs while playing. Thus, in order to overcome certain of the problems encountered by disc golf players, the present invention was conceived and one of its objectives to provide umbrella apparatus which consists of a hollow, longitudinal member which can contain an easy accessible umbrella.

It is another objective of the present invention to provide an apparatus which will hold a player's bag or satchel containing golf discs.

It is still another objective of the present invention to provide umbrella apparatus which is fitted at one end with a stirrup-like anchor device for quick and convenient insertion into the ground while waiting a turn to toss the disc.

It is yet another objective of the present invention to provide umbrella apparatus which contains a suction cup at one end to allow the user to easily pick up a disc without having to overly stoop or bend.

Various other objectives and advantages of the present invention will become apparent to those skilled in the art as a more detailed description is set forth below.

SUMMARY OF THE INVENTION

The invention herein pertains to apparatus which includes, in one embodiment a hollow, longitudinal member for containing an umbrella which is slidably removable therefrom. Hooks are included for conveniently maintaining a player's bag in a suitable location while throwing. While playing disc golf, the user can quickly remove the hand grip and extend the umbrella in the event a sudden shower. A foldable seat is also attached to the longitudinal member to allow the player to sit when desired. A stirrup-like anchor having a spike provides convenience in resting the umbrella apparatus in an upright position while tossing discs or waiting a turn.

DESCRIPTION OF THE PREFERRED EMBODIMENT AND OPERATION OF THE INVENTION

Figure 1:
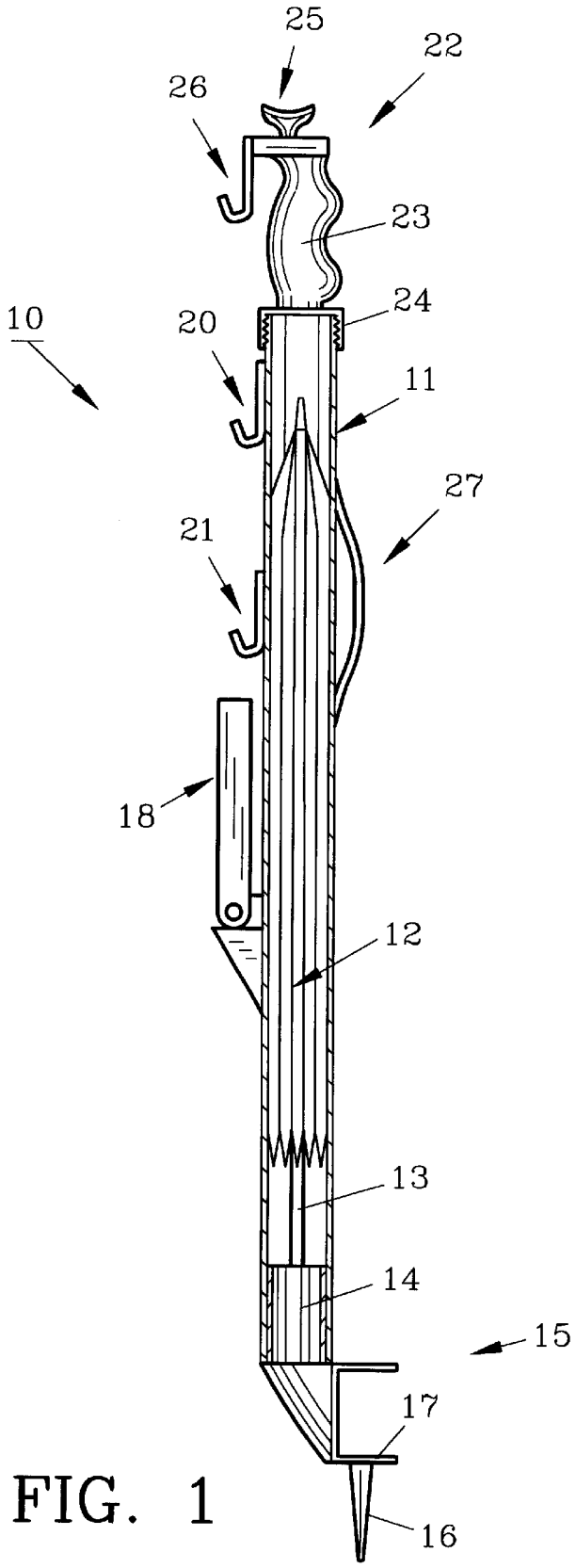
FIG. 1 demonstrates in cut-away fashion the preferred umbrella apparatus of the invention.
Figure 2:
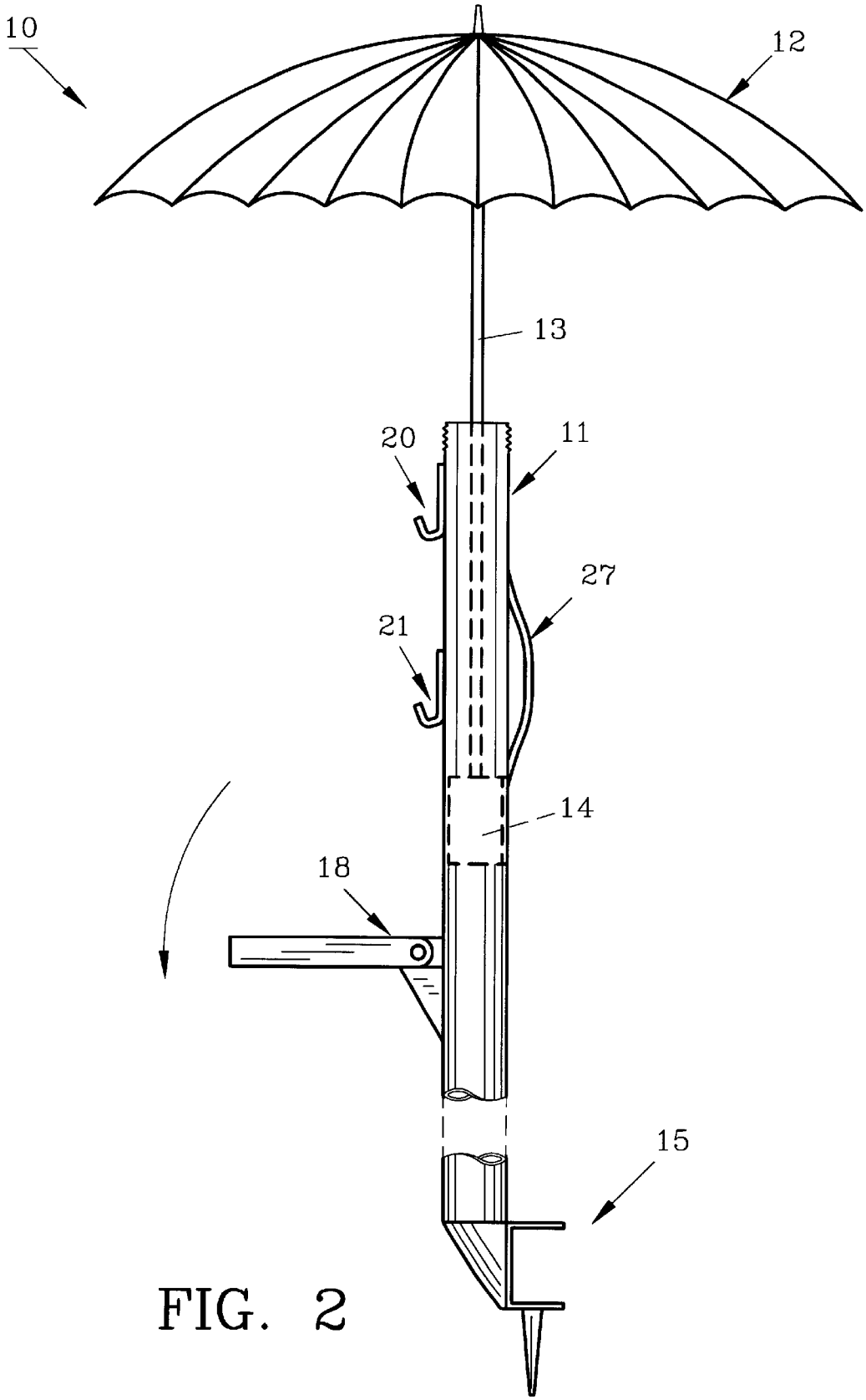
FIG. 2 features the umbrella apparatus of FIG. 1 but with the umbrella open and partially extended from the longitudinal member.

For a better understanding of the invention, turning now to the drawings, FIG. 1 demonstrates a preferred form of umbrella apparatus 10 comprising a hollow, cylindrical, longitudinal member 11 which may be formed from metal, plastic or other suitable materials. Longitudinal member 11 contains umbrella 12 which has a shaft 13 and cylindrical handle 14. Umbrella handle 14 is sized to slide within longitudinal member 11 and can be manually raised and opened as shown in FIG. 2. Stirrup-like anchor 15 provides convenience when driving spike 16 into the ground as a shoe can be placed on step 17 to force spike 16 into the ground or other surface as desired. Anchor 15 is connected to longitudinal member 11 by conventional fasteners (not shown) such as screws, bolts, brads or otherwise and may be integrally formed with spike 16 such as by welding or the like.

In use, once spike 16 is firmly inserted into the ground, seat 18 can be folded down as shown in FIG. 2 for sitting. Hooks 20, 21 provide convenience to the user in that bags, caps or other articles can be hung therefrom.

As further shown in FIG. 1, hand grip 22 includes grip portion 23 which is affixed to cap 24 for using longitudinal member 11 as a cane during walking. Hand grip 22 further includes suction cup 25 which malt be used for picking up discs. Hand grip 22 further includes hook 26 for suspending articles as earlier described regarding hooks 20, 21. Should umbrella 12 be needed, grip portion 23 is rotated for threadable removal of cap 24. Umbrella 12 can then be extended as shown in FIG. 2 for protection from adverse weather conditions. Flexible handle 27 is also attached to longitudinal member 11 by conventional means and is used in the normal carrying of umbrella apparatus 10.

In FIG. 2 umbrella 12 is partially extended from longitudinal member 11 and can be raised or lowered further as required. As would be understood, umbrella handle 14 is in frictional engagement with the interior walls of longitudinal member 11 and will remain at its raised or lowered position within longitudinal member 11 until such time as umbrella 12 is further manually raised or lowered.

Umbrella apparatus 10 provides a versatile tool for use while playing disc golf in that umbrella apparatus 10 can be inverted and by using suction cup 25, disc can be easily picked up from the ground or other surface. Seat 18 allows a player to rest while waiting for his turn and umbrella 12 can be easily and conveniently used as needed.

Figure 3:
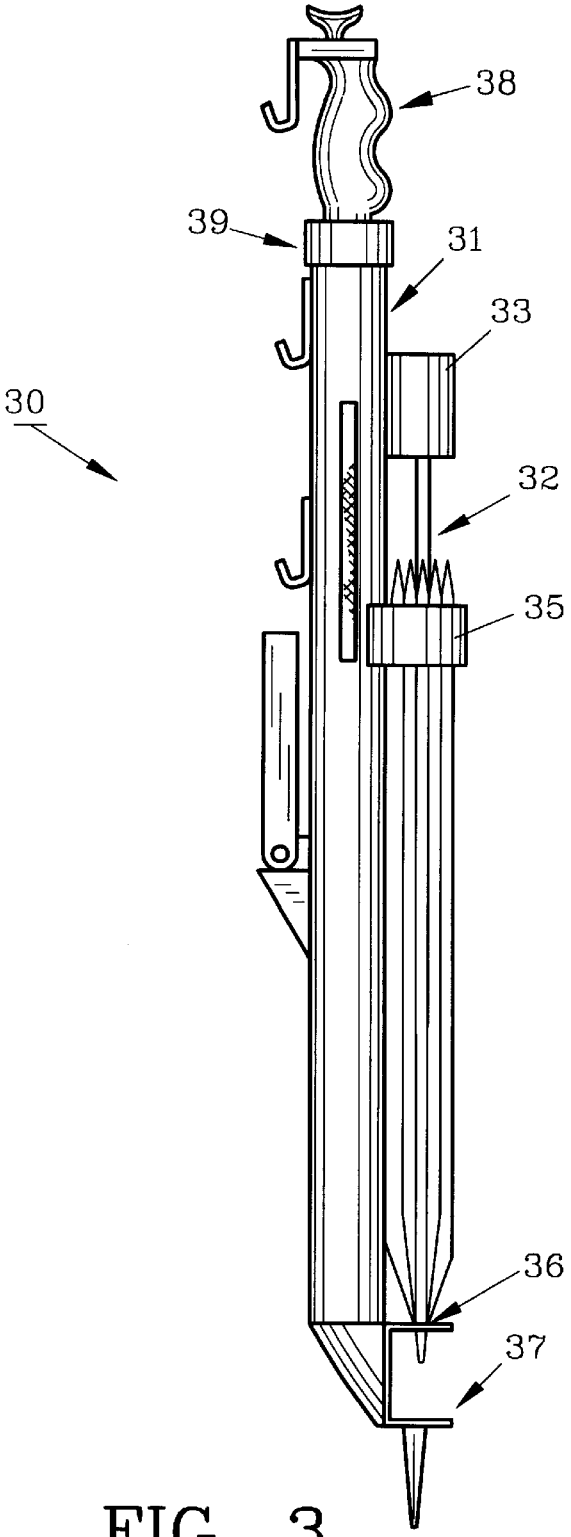
FIG. 3 shows an alternate embodiment of the invention with the umbrella affixed in side-by-side relation.
Figure 4:
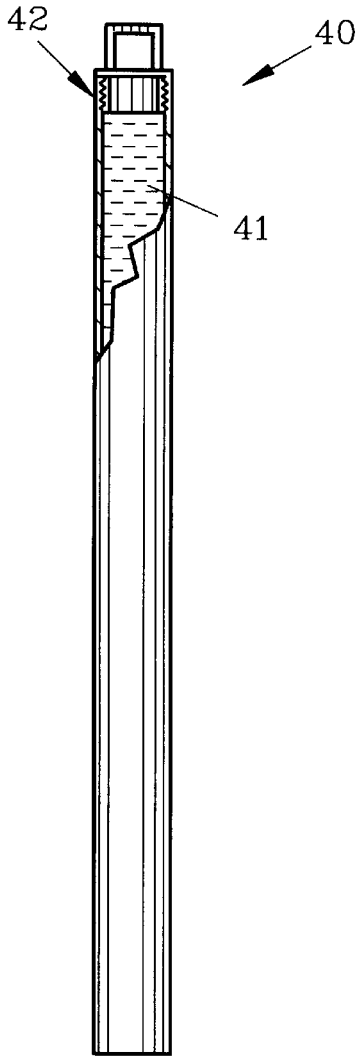
FIG. 4 depicts a beverage container as may be used with the umbrella apparatus.

An alternate embodiment is shown at FIG. 3 whereby umbrella apparatus 30 includes longitudinal member 31 with umbrella 32 exteriorly attached in side-by-side relation. As shown, umbrella 32 includes a cylindrical handle 33 which can be slidably positioned in longitudinal member 31 as previously described. While umbrella 32 is in a stored condition as shown in FIG. 3, a means to fasten said umbrella to longitudinal member 31 is provided by band 35 which may be formed of fabric or suitable polymeric material for engaging umbrella 32 while aperture 36 of anchor 37 assists in containing umbrella 32 in side-by-side relation with longitudinal member 31. Should umbrella 32 be needed, hand grip 38 which includes threaded cap 39 is removed from longitudinal member 31 and umbrella handle 33 is then inserted into longitudinal member 31 as hereinbefore described. Longitudinal member 31 can, if desired, be used to carry other articles and objects as needed such as cylindrical liquid beverage container 40, shown in FIG. 4.

Beverage container 40 may be filled with water 41 which is then accessible by removing threaded cap 42 therefrom.

The illustrations and examples provided herein are for explanatory purposes and are not intended to limit the scope of the appended claims.

I claim:

1. An umbrella apparatus comprising: a longitudinal member, said longitudinal member for holding an umbrella, a suction cup, said suction cup affixed at one end of said longitudinal member, and an anchor, said anchor affixed at the other end of said longitudinal member.

2. The umbrella apparatus as claimed in claim 1 wherein said longitudinal member comprises a hollow cylinder.

3. The umbrella apparatus as claimed in claim 1 further comprising a seat, said seat foldably attached to said longitudinal member.

4. The umbrella apparatus as claimed in claim 1 wherein said anchor comprises a spike.

5. The umbrella apparatus as claimed in claim 4 further comprising an anchor step, said anchor step affixed to said longitudinal member for urging said spike into the ground.

6. The umbrella apparatus as claimed in claim 2 further comprising a beverage container, said beverage container for storing inside said hollow cylinder.

7. The umbrella apparatus as claimed in claim 1 further comprising a hook, said hook attached to said longitudinal member.

8. The umbrella apparatus as claimed in claim 2 wherein said umbrella is slidably positioned within said hollow cylinder.

9. The umbrella apparatus as claimed in claim 1 further comprising a carrying handle, said carrying handle affixed to said longitudinal member.

10. The umbrella apparatus as claimed in claim 1 further comprising a hand grip, said hand grip attached to said longitudinal member.

11. An umbrella apparatus comprising: a longitudinal member, an umbrella, said umbrella affixed to one end of said longitudinal member, an anchor, said anchor affixed at the other end of said longitudinal member, and a suction cup, said suction cup affixed to said longitudinal member.

12. The umbrella apparatus as claimed in claim 11 further comprising a means to fasten said umbrella in side-by-side relation to said longitudinal member, said fastening means attached to said longitudinal member.

* * * * *